US005635796A

United States Patent [19]

Genz

[11] Patent Number: 5,635,796

[45] Date of Patent: Jun. 3, 1997

[54] HIGH-PRESSURE DISCHARGE LAMP INCLUDING HALIDES OF TANTALUM AND DYSPROSIUM

[75] Inventor: Andreas Genz, Berlin, Germany

[73] Assignee: Patent-Treuhand-Gesellschaft für elektrische Glühlampen mbH, Munich, Germany

[21] Appl. No.: 525,758

[22] PCT Filed: Mar. 25, 1994

[86] PCT No.: PCT/DE94/00343

§ 371 Date: Sep. 25, 1995

§ 102(e) Date: Sep. 25, 1995

[87] PCT Pub. No.: WO94/23441

PCT Pub. Date: Oct. 13, 1994

[30] Foreign Application Priority Data

Mar. 31, 1993 [DE] Germany ..... 43 10 539.4

[51] Int. Cl.[6] ..... H01J 61/20

[52] U.S. Cl. ..... 313/641

[58] Field of Search ..... 313/570, 571, 313/637, 638, 639, 640, 641, 642, 643

[56] References Cited

U.S. PATENT DOCUMENTS

| | | | |
|---|---|---|---|
| 3,521,110 | 7/1970 | Johnson | 313/571 |
| 3,761,758 | 9/1973 | Bamberg et al. | 313/640 |
| 4,229,673 | 10/1980 | McAllister | 313/225 |
| 4,622,493 | 11/1986 | Yasuda et al. | 313/642 |
| 4,686,419 | 8/1987 | Block et al. | 313/641 |
| 5,220,244 | 6/1993 | Maseki et al. | 313/620 |
| 5,323,085 | 6/1994 | Genz | 313/570 |
| 5,504,392 | 4/1996 | Natour | 313/570 |

FOREIGN PATENT DOCUMENTS

| | | | |
|---|---|---|---|
| 0 386 601 | 9/1990 | European Pat. Off. | H01J 61/82 |

*Primary Examiner*—Michael Horabik
*Assistant Examiner*—Michael Day
*Attorney, Agent, or Firm*—Frishauf, Holtz, Goodman, Langer & Chick, P.C.

[57] ABSTRACT

A high-pressure metal-halide discharge lamp (1) having a mean arc power between 60 and 140 W/mm arc length includes a discharge vessel (2), two electrodes (5,6), a fill of mercury, at least one noble gas, at least one halogen, cesium, and tantalum and dysprosium for forming metal halides to produce light with a color temperature between 400 and 700 K at a wall load of between 40 and 85 W/cm$^2$ wall area. The tantalum maintains the halogen cycle process at relatively low wall loads, and thus prevents blackening and devitrification of the bulb, while dysprosium provides a high radiation flux in the visible range of the optical spectrum and thus optimizes color reproduction. At a wall load of between 40 and 85 W/cm$^2$, optimum results are attained if the fill contains from 0.2 to 1.5 mg of tantalum and dysprosium per cm$^3$ of vessel volume, in a weight ratio of tantalum to dysprosium of between 0.3 and 1.5. As a result, lamp service life of 1500 hours at a color temperature of 5500 K are attained.

7 Claims, 1 Drawing Sheet

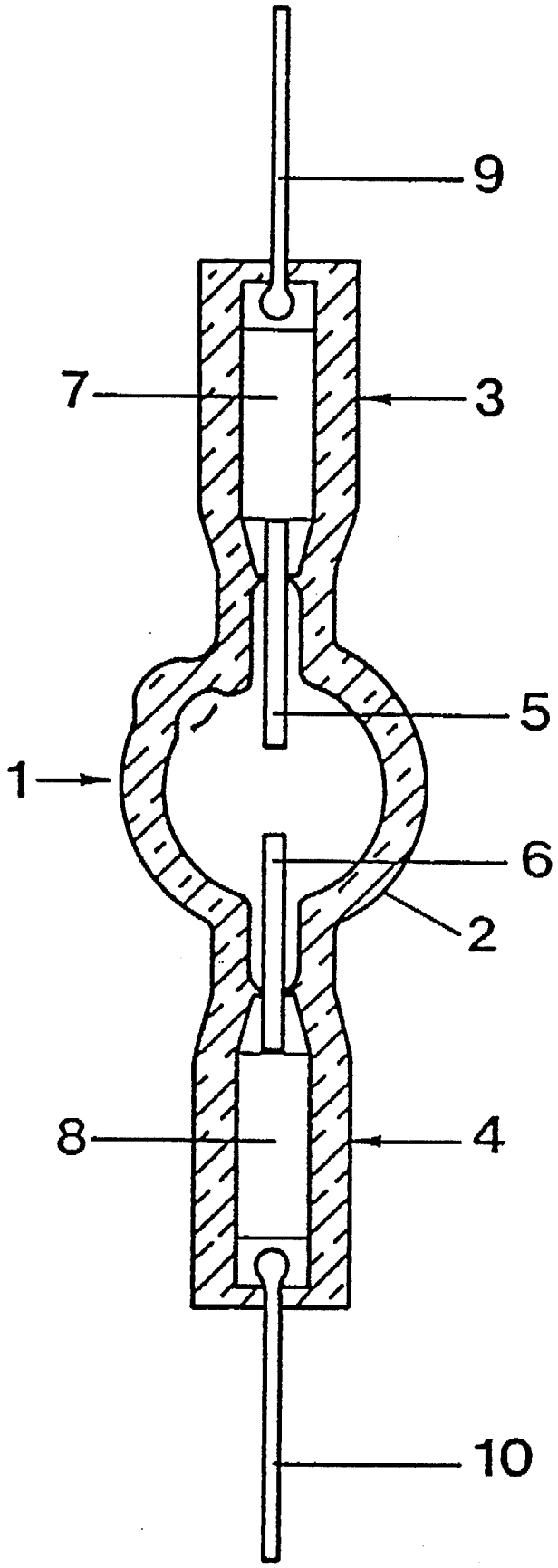
9
7
3
5
1
6
2
8
4
10

HIGH-PRESSURE DISCHARGE LAMP INCLUDING HALIDES OF TANTALUM AND DYSPROSIUM

The invention relates to a high-pressure metal-halide discharge lamp with a mean arc power between 60 and 140 W/mm arc length, for fitting in optical systems, as generically defined by the preamble to claim 1. High-pressure metal-halide discharge lamps of this type are used particularly in projection systems (slide projectors, overhead projectors, amateur and professional movie projectors) and glass fiber lighting systems (endoscopy, microscopy, effect lighting for film and television), where light with color temperatures between 4000 and 7000 K and good to very good color reproduction in all color temperature ranges are needed. They are distinguished by a very short arc light (a few millimeters) and maximum light densities (on average, several tens of kcd/cm$^2$), which predestines them for installation in reflectors or other optical imaging systems.

European Patent Disclosure EP 0 193 086 and German Patent Disclosure DE-A 4 040 858 disclose high-pressure metal-halide discharge lamps with short arcs and correspondingly high light densities, which produce light with a spectral composition similar to daylight. However, their disadvantage is that these lamps have average service lives of only a few hundred hours.

The object of the invention is to create a high-pressure metal-halide discharge lamp that has an average service life of at least 1000 hours of operation, has a very short arc with very high light density, and has a color temperature between 4000 and 7000 K = with very good color reproduction—and that attains this goal with the fewest possible elements in its filling.

This object is attained by the characteristics of the body of claim 1. Other advantageous characteristics are recited in the dependent claims.

The high-pressure metal-halide discharge lamp according to the invention is operated at specific arc powers between 60 and 140 W/mm of arc length and at comparably low wall loads of between 40 and 85 W per cm$^2$ of wall area. With conventional fillings, at wall loads below or above approximately 60 W/cm$^2$, bulb blackening or devitrification occurs within a short time, and the value for these limits can vary depending on the cooling. As a result, the useful light flux drops, and the lamp life is shortened.

To the filling of the lamp according to the invention—which comprises mercury, at least one noble gas and at least one halogen and cesium—tantalum and dysprosium are added, preferably in a ratio by weight of between 0.3 and 1.5; the total quantity of these two important additives to the filling is advantageously between 0.2 and 1.5 mg/cm$^3$. Tantalum maintains the halogen cycle process even at relatively low wall loads and thus largely prevents blackening and devitrification of the bulb, so that a long average service life can be attained. Tantalum also contributes to the continuum proportion in the optical spectrum. Dysprosium, with its multi-line spectrum, assures a high radiation flux in the visible range of the optical spectrum. By means of the addition of tantalum and dysprosium according to the invention, the tendency to devitrification and blackening of the bulb is accordingly minimized—that is, the mean service life is correspondingly prolonged—and the light flux and the color reproduction are optimized.

If the color temperature is to be lowered and/or particularly good color reproduction is to be attained, then optionally lithium can be added in addition, in a proportion up to 0.2 mg/cm$^3$ of the vessel volume; this increases the red proportion in the radiation, which can be advantageous particularly when the lamp is used in a dichroitic cold-light reflector, which raises the color temperature of the reflected radiation somewhat compared with the total radiation of the discharge. Moreover, lithium is an atomic line radiator, which radiates preferably in the hot arc core and is therefore projected especially efficiently by suitably focusing special reflectors that project only the inner arc core.

For arc stabilization, the discharge vessel can contain cesium in a proportion up to 0.8 mg/cm$^3$ of the vessel volume. Iodine and bromine in a molar ratio between 0.2 and 2 are preferably used as the halogens.

The invention will be described in further detail in terms of the exemplary embodiments below.

The drawing shows a sectional side view through a high-pressure metal-halide discharge lamp according to the invention.

In the drawing, a high-pressure metal-halide discharge lamp 1 according to the invention with a power consumption of 400 W, of a kind that can be used in a reflector system, is shown schematically (not to scale). The discharge vessel 2 of quartz glass is essentially spherical in form and at each of two diametrically opposed points has a neck 3, 4, into which pronglike tungsten electrodes 5, 6 are sealed in by means of sealing foils 7, 8 of molybdenum. The ends of the sealing foils 7, 8 remote from the discharge chamber are welded to current supply leads 9, 10, which on installation in a reflector system are connected with the electrical terminals in the reflector.

Table 1 shows two fillings according to the invention of the discharge vessel 2 of a 400 W lamp, with the service lives attained thereby, along with the lighting specification data of this lamp. By adding lithium to the filling 2, the color temperature is lowered by approximately 500 K compared with the filling 1.

TABLE 1

| | Filling 1 | Filling 2 |
|---|---|---|
| Li in mg | — | 0.005 |
| $I_2$ in mg | 0.9 | 0.92 |
| $Br_2$ in mg | 0.75 | 0.75 |
| Cs in mg | 0.22 | 0.22 |
| Dy in mg | 0.24 | 0.24 |
| Ta in mg | 0.16 | 0.16 |
| Hg in mg | 30.5 | 30.5 |
| Ar in mbar | 450 | 450 |
| Discharge vessel volume in ml: | 1.3 | 1.3 |
| Power consumption in W: | 400 | 400 |
| Wall load in W/cm$^2$ | 68 | 68 |
| Specific power in W/mm arc length: | 95 | 95 |
| Color temperature in K: | 5500 | 5000 |
| Service life in h: | 1500 | 1500 |
| Electrode spacing in mm: | 4 | 4 |
| Light yield in lm/W: | 70 | 69 |
| Mean light density in kcd/cm$^2$: | 30 | 30 |
| Arc drop voltage in V: | 55 | 55 |
| Color reproduction index Ra: | 90 | 90 |

Another exemplary embodiment relates to a high-pressure metal-halide discharge lamp according to the invention with a power consumption of 270 W. It differs in its design from the lamp shown in the drawing essentially only in having a smaller discharge volume and a shorter electrode spacing and has therefore not been shown in the drawing.

Table 2 shows a filling according to the invention of the discharge vessel of a 270 W lamp, with the light specification data of this lamp.

TABLE 2

| | |
|---|---|
| Li | 0.005 mg |
| $I_2$ | 0.75 mg |
| $Br_2$ | 0.36 mg |
| Cs | 0.1 mg |
| Dy | 0.13 mg |
| Ta | 0.08 mg |
| Hg | 13.2 mg |
| Ar | 450 bar |
| Discharge vessel volume: | 0.55 ml |
| Power consumption: | 270 W |
| Wall load: | 81 W/cm$^2$ |
| Specific power | 117 W/mm |
| Color temperature: | 5000 K. |
| Service life: | 1000 h |
| Electrode spacing: | 2.3 mm |
| Light yield: | 70 lm/W |
| Mean light density: | 35 kcd/cm$^2$ |
| Arc drop voltage: | 45 V |
| Color reproduction index Ra: | 80 |

I claim:

1. A high-pressure metal-halide discharge lamp (1), having a mean arc power between 60 and 140 W/mm arc length for fitting in optical systems, having a discharge vessel (2) of high-temperature-proof transparent material, two high-temperature-proof electrodes (5, 6), and a filling that comprises mercury, at least one noble gas, at least one halogen, cesium, and further metals for forming metal halides, characterized in that to produce light with a color temperature between 4000 and 7000 K, at a wall load at the lamp (1) between 40 and 85 W/cm$^2$ at wall area, the filling contains tantalum and dysprosium as further metals.

2. The high-pressure metal-halide discharge lamp of claim 1, characterized in that the discharge vessel contains tantalum and dysprosium in a ratio by weight of between 0.3 and 1.5.

3. The high-pressure metal-halide discharge lamp of claim 1, characterized in that the discharge vessel contains tantalum and dysprosium, and the sum of the filling quantities of the two components is between 0.2 and 1.5 mg/cm$^3$ of the vessel volume.

4. The high-pressure metal-halide discharge lamp of claim 1, characterized in that the discharge vessel additionally contains lithium.

5. The high-pressure metal-halide discharge lamp of claim 4, characterized in that the filling quantity of the lithium amounts to up to 0.2 mg/cm$^3$ of the vessel volume.

6. The high-pressure metal-halide discharge lamp of claim 1, characterized in that the discharge vessel, as halogens for the halide compounds, contains iodine and bromine in a molar ratio between 0.2 and 2.

7. The high-pressure metal-halide discharge lamp of claim 1, characterized in that the discharge vessel contains cesium in a quantity up to 0.8 mg/cm$^3$ of the vessel volume.

* * * * *